US012173472B2

(12) United States Patent
Hirakawa et al.

(10) Patent No.: US 12,173,472 B2
(45) Date of Patent: Dec. 24, 2024

(54) SUPPORT STRUCTURE FOR WORK VEHICLE AND WORK VEHICLE

(71) Applicant: Kubota Corporation, Osaka (JP)

(72) Inventors: Hironori Hirakawa, Sakai (JP); Satoshi Yamaki, Sakai (JP); Kiyoshi Ueda, Sakai (JP); Hiroshi Fujiwara, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 321 days.

(21) Appl. No.: 17/961,558

(22) Filed: Oct. 7, 2022

(65) Prior Publication Data

US 2023/0203781 A1 Jun. 29, 2023

(30) Foreign Application Priority Data

Dec. 28, 2021 (JP) ..... 2021-213865

(51) Int. Cl.
*E02F 9/08* (2006.01)

(52) U.S. Cl.
CPC ..... *E02F 9/0866* (2013.01); *E02F 9/0891* (2013.01)

(58) Field of Classification Search
CPC ..... E02F 9/0866; E02F 9/0891
See application file for complete search history.

(56) References Cited

U.S. PATENT DOCUMENTS 3,834,478 A 9/1974 Alexander et al.
4,287,961 A 9/1981 Steiger
5,676,197 A 10/1997 Diebold et al.
6,435,264 B1 * 8/2002 Konno ..... F01P 3/18 165/41
7,481,287 B2 * 1/2009 Madson ..... F01P 5/06 180/68.1

(Continued)

FOREIGN PATENT DOCUMENTS

CN 201784450 U 4/2011
JP 2004-278379 10/2004

(Continued)

OTHER PUBLICATIONS

Terex Corporation, "Terex Service Manual Skid Steer Loader TSR-50/60", Jan. 2011, www.terex.com.

(Continued)

*Primary Examiner* — Erez Gurari
(74) *Attorney, Agent, or Firm* — MORI & WARD, LLP

(57) ABSTRACT

A support structure includes a shroud having a substantially circular shape from a proximal end covering an outer periphery of a first surface of a heat exchanger to a distal end. A support frame supports the heat exchanger and the shroud to expose the distal end and a second surface of the heat exchanger. The vehicle body frame has an opening. A cooling fan includes a fan rotating shaft and blades to generate cooling air. When the heat exchanger is positioned at the first position facing the cooling fan, the distal end of the shroud covers a circumference of the cooling fan in a radial direction so that cooling air passes through the first and second surfaces. When the support frame is located at a second position where the heat exchanger exposes the opening to an outside of the vehicle frame, the fan rotating shaft and the blades are uncovered.

16 Claims, 10 Drawing Sheets

(56) References Cited

U.S. PATENT DOCUMENTS

| | | | | |
|---|---|---|---|---|
| 8,544,584 | B2 * | 10/2013 | Takeda | E02F 9/26 165/41 |
| 8,672,071 | B2 | 3/2014 | Neilson | |
| 8,960,342 | B2 | 2/2015 | Werner et al. | |
| 10,233,819 | B2 | 3/2019 | Darling et al. | |
| 10,273,653 | B1 * | 4/2019 | Mori | E02F 9/0866 |
| 11,951,797 | B2 * | 4/2024 | Simofi-Ilyes | B60K 11/02 |
| 2005/0173095 | A1 * | 8/2005 | Fujita | B60H 1/00378 165/77 |
| 2005/0279548 | A1 * | 12/2005 | Kurtz | B60K 11/04 180/68.6 |
| 2009/0272341 | A1 * | 11/2009 | Ito | B60K 11/04 165/67 |
| 2011/0272967 | A1 * | 11/2011 | Davisdon | B60R 19/52 165/104.34 |
| 2012/0103711 | A1 * | 5/2012 | Smith | F01N 13/002 180/68.1 |
| 2013/0000999 | A1 * | 1/2013 | Naito | B60K 11/08 180/68.1 |
| 2014/0138066 | A1 * | 5/2014 | Bibb, III | F28F 9/002 165/121 |
| 2014/0224558 | A1 | 8/2014 | Kure | |
| 2016/0369478 | A1 * | 12/2016 | Kokuryou | E02F 9/0866 |
| 2017/0218832 | A1 * | 8/2017 | Kurokawa | B62D 25/04 |
| 2018/0258831 | A1 * | 9/2018 | Seto | F04D 29/601 |
| 2018/0266075 | A1 * | 9/2018 | Miyamoto | B66C 13/52 |
| 2018/0266076 | A1 * | 9/2018 | Sakron | B60K 11/02 |
| 2018/0266303 | A1 * | 9/2018 | Miyamoto | B60K 11/04 |
| 2023/0203781 | A1 * | 6/2023 | Hirakawa | E02F 9/0866 180/68.1 |
| 2024/0084548 | A1 * | 3/2024 | Kim | F01N 3/02 |
| 2024/0092161 | A1 * | 3/2024 | Alberda | B60K 11/04 |

FOREIGN PATENT DOCUMENTS

| | | | |
|---|---|---|---|
| JP | 4183584 | B2 | 3/2005 |
| JP | 5455482 | B2 | 2/2011 |
| JP | 2011-140839 | | 7/2011 |
| JP | 5744695 | B2 | 5/2013 |
| JP | 5204911 | B1 | 6/2013 |
| JP | 6574357 | B2 | 2/2017 |
| JP | 2018-119457 | | 8/2018 |
| JP | 6767270 | B2 | 8/2018 |
| JP | 2018-159270 | | 10/2018 |
| KR | 10-2021-0142824 | | 11/2021 |

OTHER PUBLICATIONS

Japanese Office Action for corresponding JP Application No. 2021-213865, Aug. 20, 2024 (w/ machine translation).

* cited by examiner

SUPPORT STRUCTURE FOR WORK VEHICLE AND WORK VEHICLE

CROSS-REFERENCE TO RELATED APPLICATIONS

The present application claims priority under 35 U. S. C. § 119 to Japanese Patent Application No. 2021-213865, filed Dec. 28, 2021. The contents of this application are incorporated herein by reference in their entirety.

BACKGROUND OF THE INVENTION

Field of the Invention

The present invention relates to a support structure for a work vehicle and to a work vehicle.

Discussion of the Background

Japanese Patent No. 6767270 discloses a work vehicle including a radiator fan provided in an engine compartment and a radiator provided on a member capable of being opened and closed with respect to the engine compartment.

SUMMARY OF THE INVENTION

According to one aspect of the present disclosure, a support structure for a work vehicle includes a heat exchanger, a shroud, a support frame, and a cooling fan. The heat exchanger has a first surface and a second surface opposite to the first surface in an air-flow direction in which cooling air is configured to pass through the heat exchanger. The shroud includes has a tubular shape extending from a proximal end to a distal end opposite to the proximal end in the air-flow direction. The proximal end covers an outer periphery of the first surface of the heat exchanger. The distal end has a substantially circular shape as viewed in the air-flow direction. The support frame is configured to support the heat exchanger and the shroud to expose the distal end of the shroud and the second surface of the heat exchanger. A vehicle body frame includes a support wall, and has an opening, a part of an outer periphery of the opening being defined by the support wall. The hinge is connected to the support wall and the support frame, and has a hinge rotation axis substantially parallel to a wall surface of the support wall to swing the support frame around the hinge rotation axis. A cooling fan includes a fan rotating shaft having a fan rotation axis around which the fan rotating shaft is configured to rotate, the fan rotating shaft being provided such that the fan rotating shaft passes through the opening and blades provided around the fan rotating shaft in the radial direction with respect to the fan rotation axis and configured to rotate around the fan rotation axis to generate cooling air. When the support frame is positioned at a first position where the heat exchanger faces the cooling fan, the distal end of the shroud is configured to cover a circumference of the cooling fan in the radial direction so that the cooling air passes through the first surface and the second surface of the heat exchanger. When the support frame is located at a second position where the heat exchanger exposes the opening to an outside of the vehicle body frame, the fan rotating shaft and the blades being configured to be uncovered. The hinge rotation axis and fan rotation axis are skew lines. The hinge rotation axis is arranged such that, when the support frame is located at the second position, the hinge rotation axis is arranged so that the hinge rotation axis does not overlap the support wall as viewed from the width direction perpendicular to the hinge rotation axis and the fan rotation axis. A work vehicle according to a second aspect of the present disclosure includes the support structure according to the first aspect.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings.

DESCRIPTION OF THE EMBODIMENTS

Figure 1:
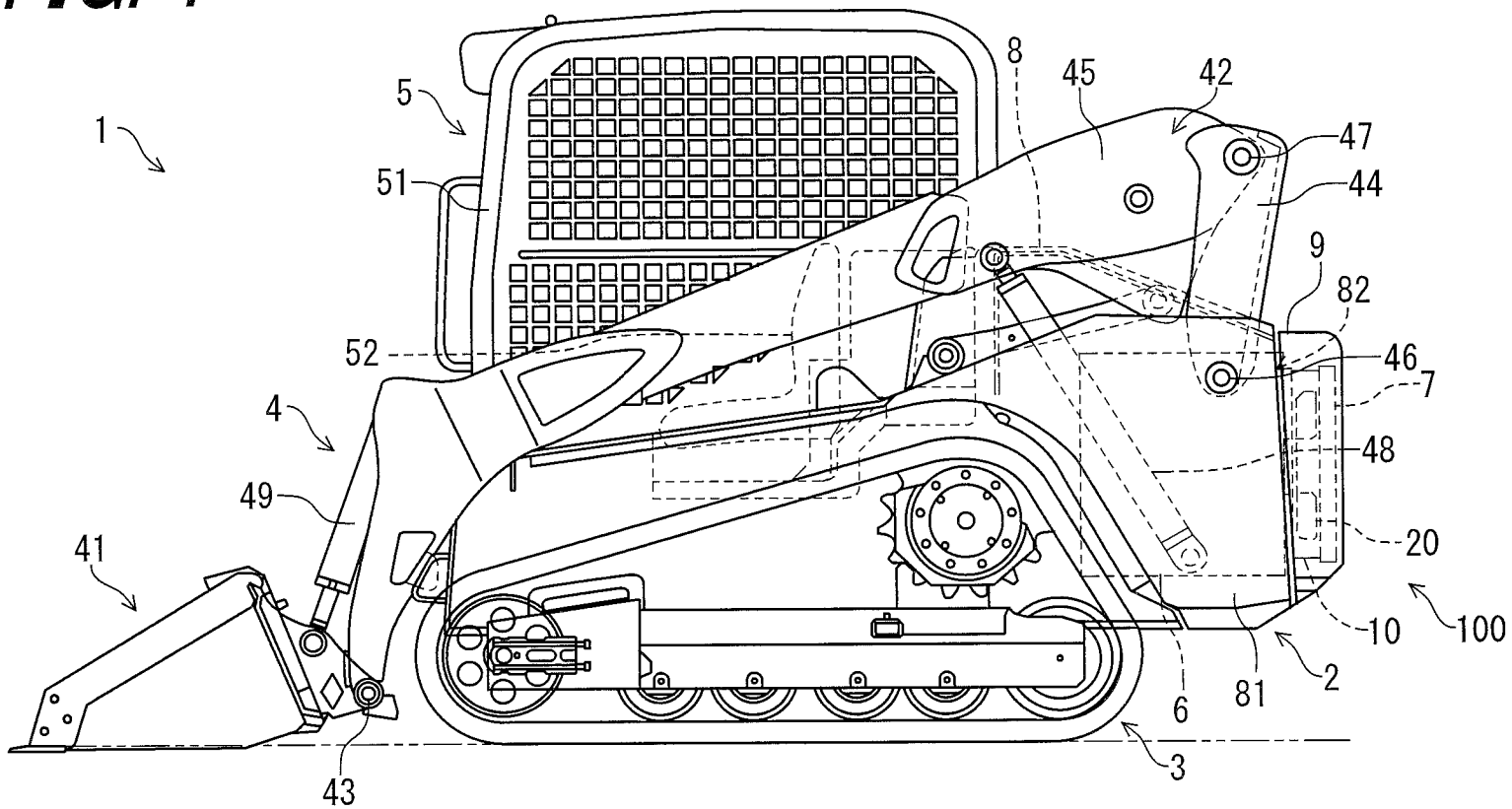
FIG. 1 is an overall side view of a work vehicle.

Embodiments of the present invention will be described below with reference to the accompanying drawings. Similar reference numerals indicate corresponding or identical components in the drawings.

First Embodiment

Referring to FIG. 1, a work vehicle 1, for example, a small-sized truck loader, includes a support structure 100 of a heat exchanger 7 according to a first embodiment of the present invention. A work vehicle 1 includes a main frame 2, a traveling device 3, a working device 4, and a cabin 5. The main frame 2 supports the traveling device 3, the working device 4, and the cabin 5. In the illustrated embodiment, the traveling device 3 is a crawler traveling device 3. However, the traveling device 3 is not limited to the crawler traveling device 3. The traveling device 3 may be, for example, a front wheel/rear wheel traveling device, or a traveling device 3 having a front wheel and a rear crawler. The working device 4 is provided with an implement (bucket) 41 at the distal end 12 of the working device 4. A proximal end of the working device 4 is attached to a rear portion of the main frame 2. A working device 4 includes a pair of arms 42 for rotatably supporting the implement (bucket) 41 via a bucket rotational shaft 43. Each of the pair of arms 42 includes a lift link 44 and a boom 45. The lift link 44 is rotatable about the first pivot pin 46 with respect to the main frame 2. The boom 45 is rotatable about the second pivot pin 47 with respect to the lift link 44. The working device 4 further includes a boom cylinder 48 and at least one implements cylinder 49. Each boom cylinder 48 is rotatably connected to the main frame 2 and the boom 45, and operates the lift link 44 and the boom 45 to raise and lower the implement (bucket) 41. At least one implements cylinder 49 is configured to incline the implement (bucket) 41. The cabin 5 is attached to a front portion of the main frame 2. The work vehicle 1 includes a front door 51 provided at a front portion of the cabin 5, a driver's seat 52 provided inside the cabin 5, and an operating device (not illustrated).

In the illustrated embodiment, one of the pair of arms 42 is provided on the left side of the cabin 5. The other of the pair of arms 42 is provided on the right side of the cabin 5. Specifically, one of the boom cylinder 48 and the boom 45 is provided on the left side of the cabin 5. The other boom cylinder 48 and the other boom 45 are provided on the right side of the cabin 5. FIG. 1 shows the left side of the work vehicle 1. However, the left and right sides of the work vehicle 1 are substantially symmetrical.

The work vehicle 1 further includes an engine 6, a heat exchanger 7, a shroud 10, and a cooling fan 20 provided at the rear portion of the main frame 2. The engine 6 is configured to provide driving force to the traveling device 3 and the working device 4. The heat exchanger 7 includes a radiator for cooling the cooling water of the engine 6. Preferably, the heat exchanger 7 includes an oil cooler for cooling a hydraulic fluid used in a hydraulic system (e.g., a boom cylinder and at least one implements cylinder 49) of the work vehicle 1. The cooling fan 20 is configured to generate cooling air for cooling the heat exchanger 7. The shroud 10 is configured to cover the outer circumference of the cooling fan 20 to efficiently send cooling air to the heat exchanger 7. The engine 6, the heat exchanger 7, the shroud 10 and the cooling fan 20 are provided between a pair of arms 42 in the left-right direction of the work vehicle 1. The engine 6, the heat exchanger 7, the shroud 10 and the cooling fan 20 are provided between the boom cylinders 48 in the lateral direction of the work vehicle 1.

Figure 2:
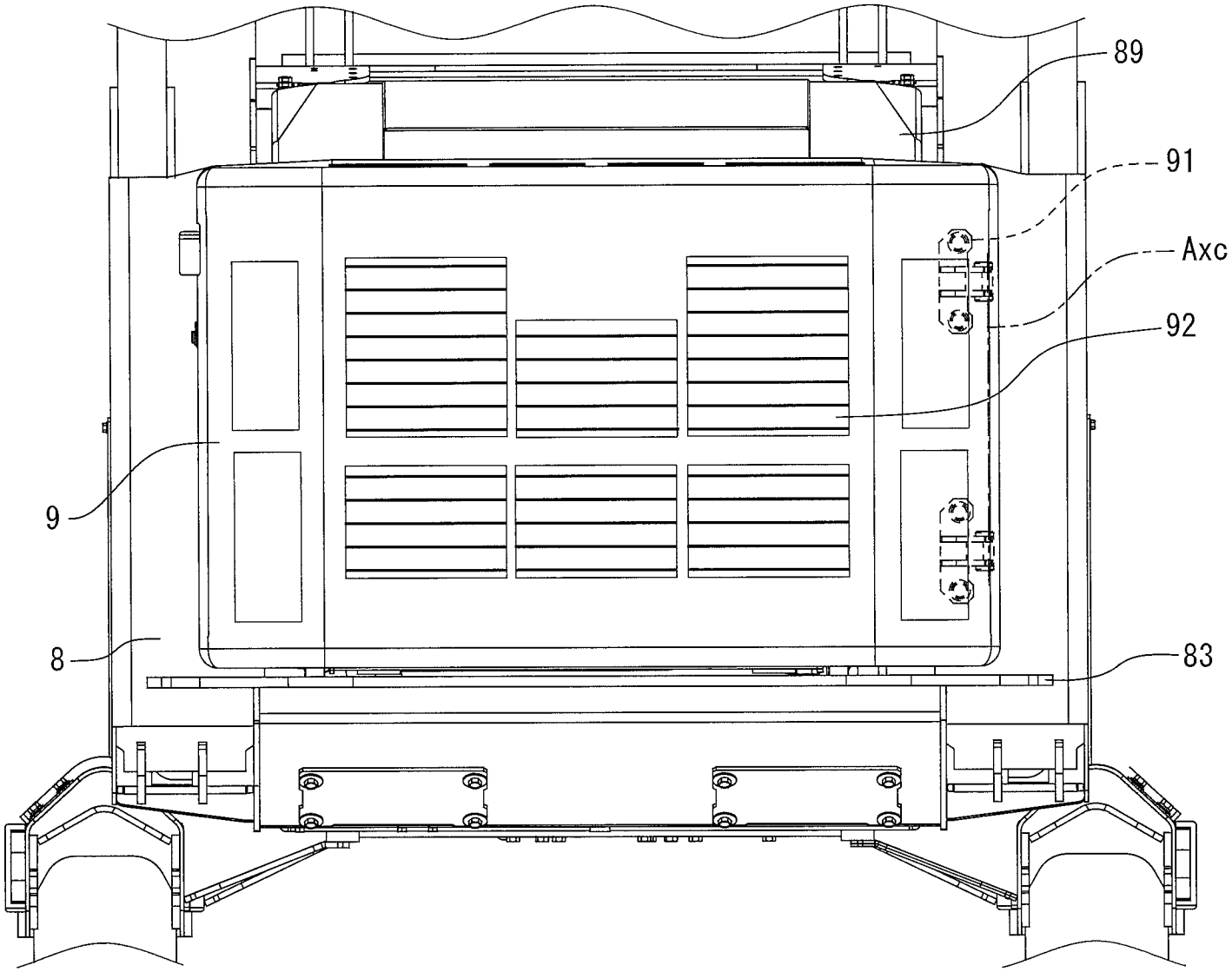
FIG. 2 is a partial rear view of a work vehicle.

The work vehicle 1 further includes a vehicle body frame 8 and bonnet cover 9. The vehicle body frame 8 includes a room cover that covers the front and peripheral portions of the engine 6 and the cooling fan 20. The bonnet cover 9 is provided at the rear end of the main frame 2 and covers an opening 82. FIG. 2 is a partial rear view of the periphery of the bonnet cover 9 of the work vehicle 1. Referring to FIG. 2, the bonnet cover 9 is swingable about a cover rotation axis Axc. In FIG. 2, since the hinge 91 for rotating the bonnet cover 9 exists on the back side of the bonnet cover 9, the hinge 91 is shown by a dotted line. The vehicle body frame 8 includes an upper cover 89 positioned above and forward of the bonnet cover. The upper cover 89 is openable and closable.

Figure 3:
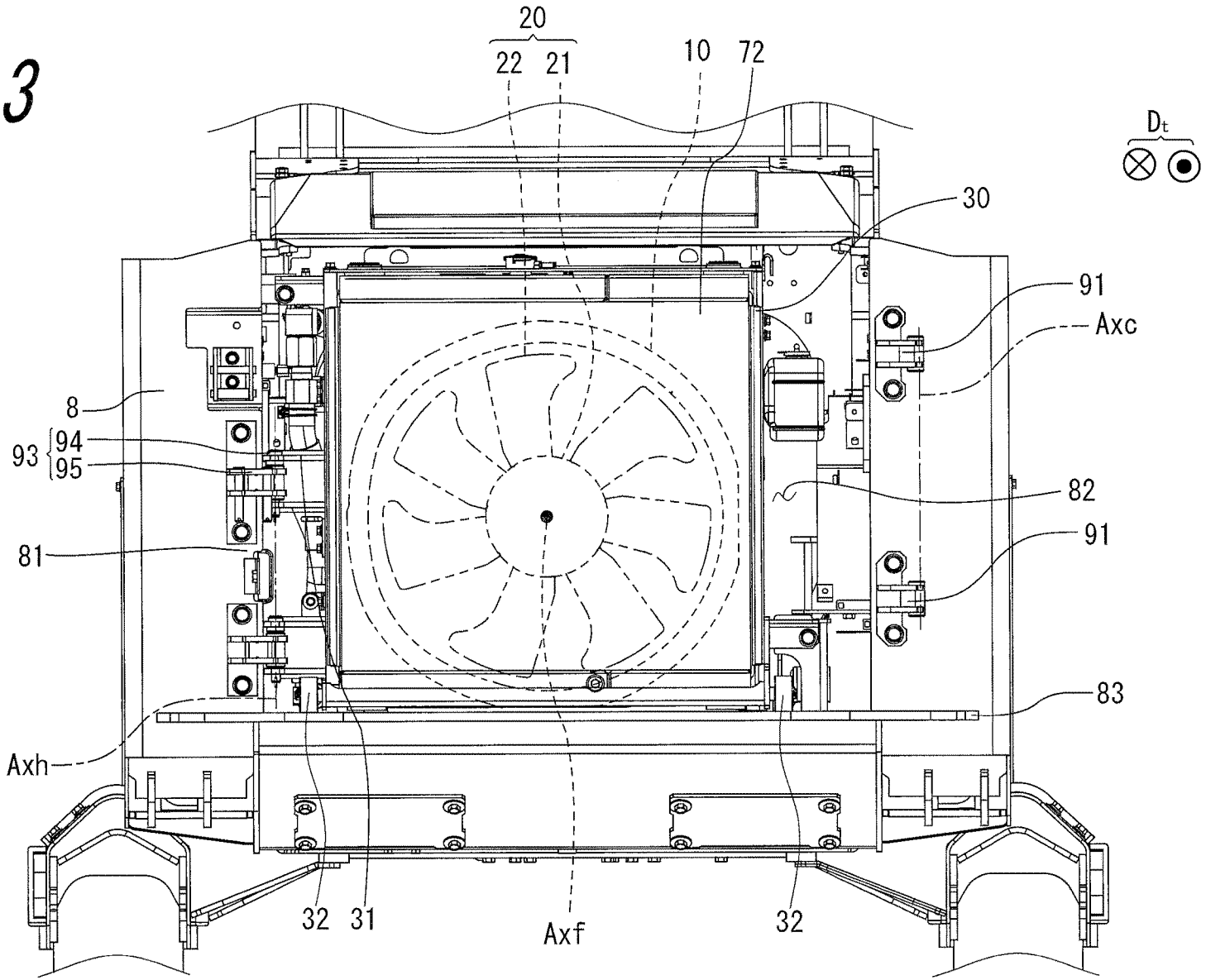
FIG. 3 is a partial rear view of the work vehicle when the bonnet cover is removed.
Figure 4:
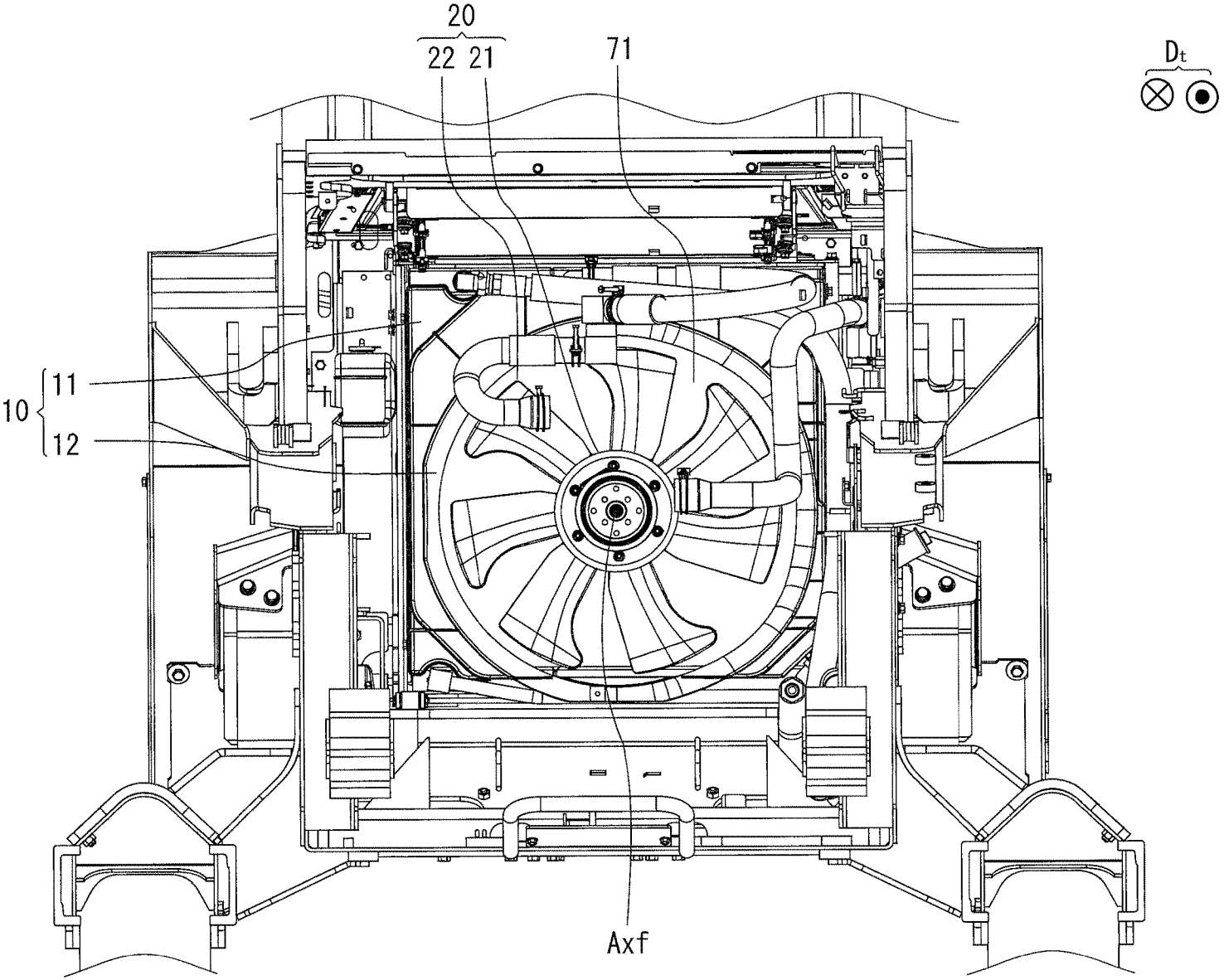
FIG. 4 is a view of a cooling fan, a shroud, and a heat exchanger from an engine.
Figure 5:
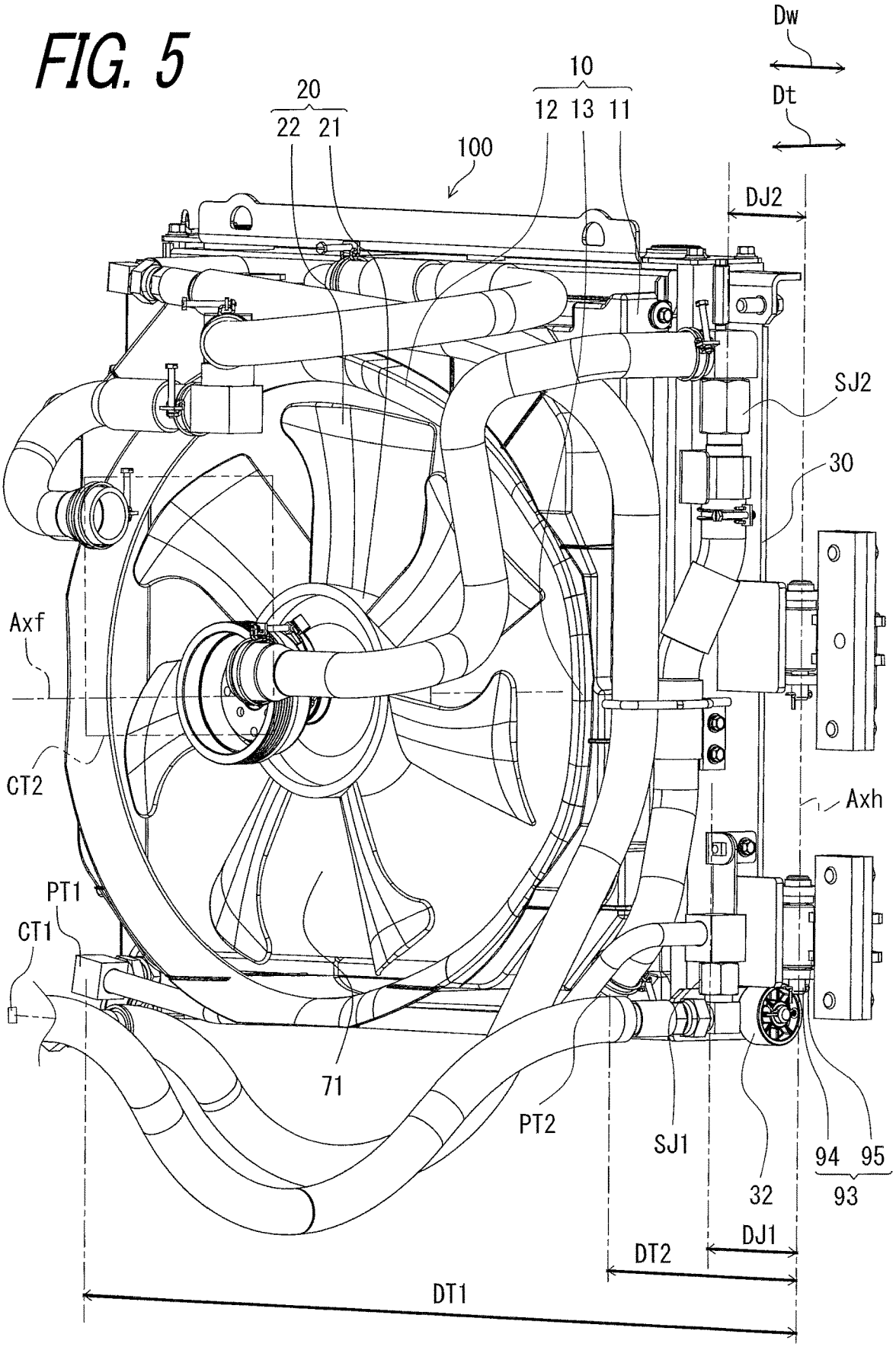
FIG. 5 is a perspective view showing a support structure of the heat exchanger according to the first embodiment.

FIG. 3 is a partial rear view of the work vehicle 1 when the bonnet cover 9 is removed. Referring to FIGS. 1 and 3, the vehicle body frame 8 includes a support wall 81 and has the opening 82 having the support wall 81 as a part of its outer periphery. FIG. 4 shows the cooling fan 20, the shroud 10, and the heat exchanger 7 as viewed from the engine 6. FIG. 5 is a perspective view showing a support structure 100 of the heat exchanger 7 according to the first embodiment. In FIGS. 3 and 4, the pair of arms 42 is not illustrated. Referring to FIGS. 3-5, the heat exchanger 7 includes a first surface 71 and a second surface 72 opposite to the first surface 71 in the thickness direction (air-flow direction) Dt. The cooling air is configured to flow through the heat exchanger 7 in the air-flow direction Dt. Referring to FIGS. 4 and 5, the shroud 10 includes a proximal end 11 covering the outer periphery of the first surface 71 of the heat exchanger 7 and a distal end 12 having a substantially circular shape as viewed in the thickness direction Dt. The shroud 10 includes a tubular shape extending in the thickness direction Dt from the proximal end 11 to the distal end 12.

The work vehicle 1 is further provided with a support frame 30 and a hinge 93. The support frame 30 supports the heat exchanger 7 and the shroud 10 to expose the distal end 12 of the shroud 10 and the second surface 72 of the heat exchanger 7. As shown in FIGS. 3 and 5, the support frame 30 is a frame-shaped member that surrounds an outer peripheral surface connecting the first surface 71 and the second surface 72 of the heat exchanger 7. Referring to FIG. 3, the hinge 93 is connected to the support wall 81 and the support frame 30. The hinge 93 is configured to swing the support frame 30 around a hinge rotation axis Axh substantially parallel to the wall surface of the support wall 81. More specifically, the hinge 93 has a hinge rotation axis Axh, extends along the hinge rotation axis Axh, and is attached to the hinge rotation shaft 94 and the support wall 81 that can swing together with the support frame 30, and includes a shaft support plate 95 having a through hole through which the hinge rotation shaft 94 passes. As a result, the support frame 30 can be opened and closed so that the heat exchanger 7 can be rotated rearward, and a maintenance operator can perform maintenance work on the heat exchanger 7 and the engine 6.

Figure 6:
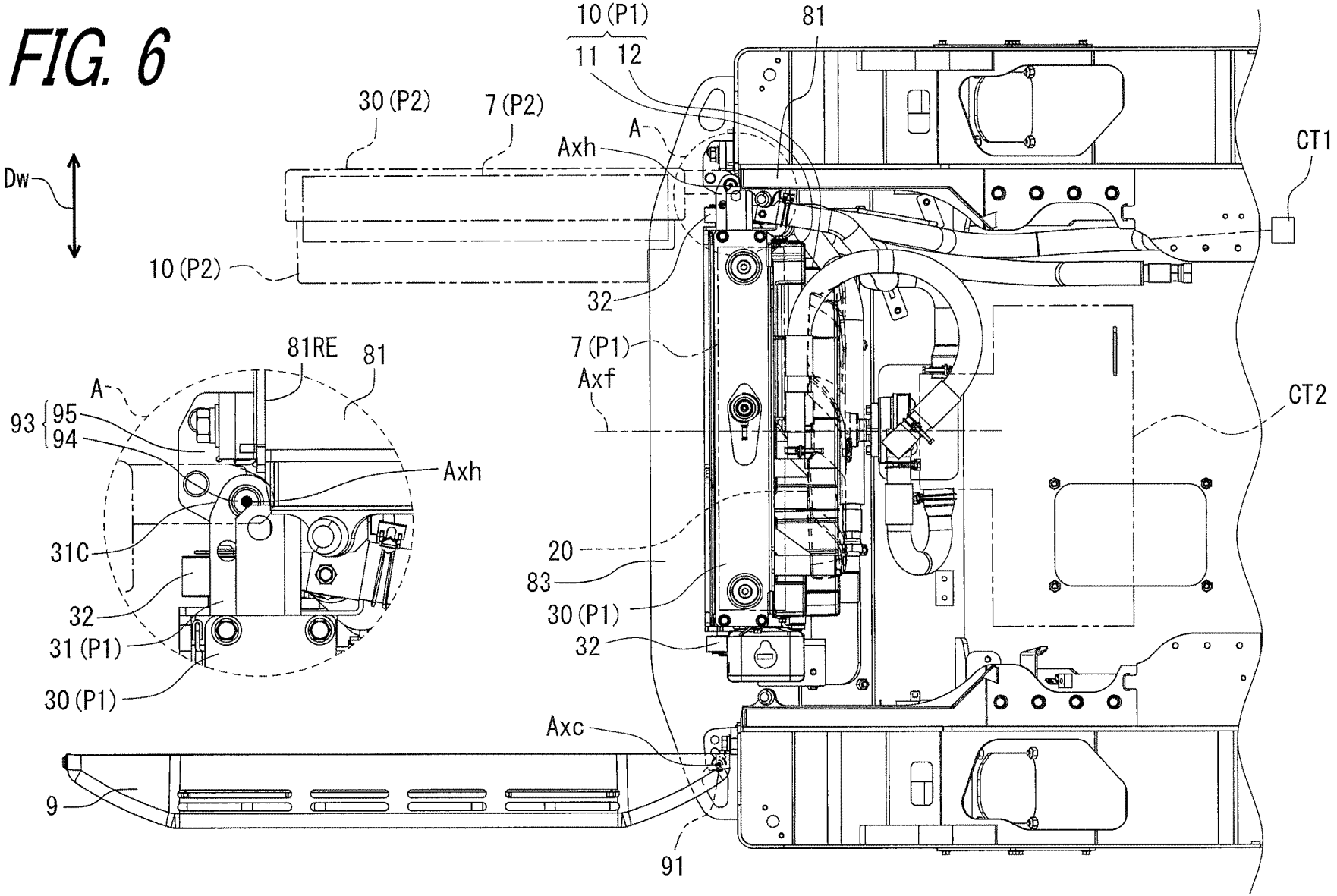
FIG. 6 is a top view of the rear portion of the work vehicle when the upper cover is removed.

FIG. 6 is a top view of the rear portion of the work vehicle 1 when the upper cover 89 is removed. In FIG. 6, the engine 6 is not illustrated. As shown in FIG. 6, the hinge rotation axis Axh is provided on the opposite side of the cover rotation axis Axe with respect to the opening 82. That is, the bonnet cover 9 and the support frame 30 are configured to open on opposite sides, respectively. Therefore, the bonnet cover 9 and the support frame 30 form double doors opening from the center, and the second surface 72 can be covered by the bonnet cover 9. Referring to FIGS. 2 and 3, the bonnet cover 9 has a plurality of air holes 92 in a portion opposed to the second surface 72 when rotated to a position at which the bonnet cover 9 covers the second surface 72. After cooling the heat exchanger 7 and the engine 6, the outside air sucked in through an air hole 92 (not illustrated) of the upper cover 89 is discharged through the air hole 92 of the upper cover 89.

Further, as shown in FIGS. 5 and 6, the support frame 30 has a roller 32 at its lower end, and the roller 32 rolls on the bottom wall 83 of the vehicle body frame 8 when the maintenance worker moves the support frame 30, so that the maintenance worker can easily move the support frame 30. Further, since the support frame 30 is supported by the bottom wall 83 through the rollers 32 during operation of the work vehicle 1, it is suppressed that a large load is applied to the hinge 93 for a long time.

Referring to FIGS. 3 to 5, the cooling fan 20 includes a fan rotating shaft 21 and a plurality of blades 22. The fan rotating shaft 21 has and extends along a fan rotation axis Axf around which the fan rotating shaft 21 is configured to rotate, the fan rotating shaft 21 being provided such that the fan rotating shaft 21 passes through the opening 82. As shown in FIG. 3 and the like, fan rotation axis Axf and hinge rotation axis Axh are skew lines. Preferably, when the fan rotation axis Axf is projected onto the surface including the rotation axis Axh, the projected line is orthogonal to the hinge rotation axis Axh. However, when the fan rotation axis Axf is projected onto the surface including the hinge rotation axis Axh, the projected line is orthogonal to the hinge rotation axis Axh. The plurality of blades 22 are provided around the fan rotating shaft 21 in the radial direction with respect to the fan rotation axis Axf. The cooling fan 20 is configured to rotate the plurality of blades 22 around the fan rotation axis Axf to generate cooling air.

Figure 7:
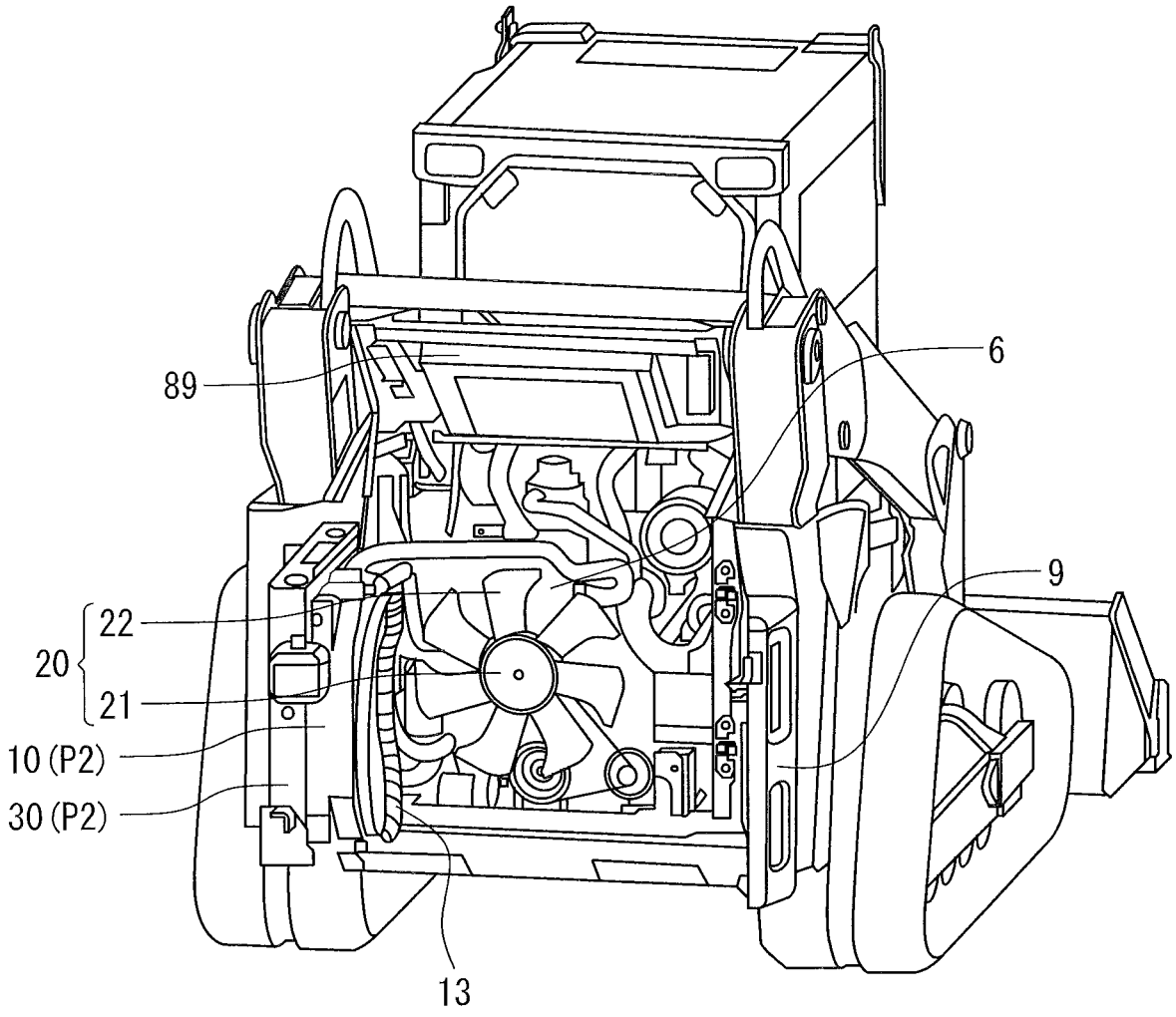
FIG. 7 is a perspective view as seen from the rear when the heat exchanger, the support frame and the shroud are arranged in the second position.

Further, referring to FIG. 6, when the support frame 30 is positioned on the first position P1 at which the heat exchanger 7 faces the cooling fan 20, the distal end 12 of the shroud 10 is configured to cover a circumference of the cooling fan 20 in the radial direction so that the cooling air passes through the first surface 71 and the second surface 72. As shown in FIG. 6 and FIG. 7 to be described later, when the support frame 30 is positioned at a second position P2 where the heat exchanger 7 exposes the opening 82 to an outside of the vehicle body frame 8, the fan rotating shaft 21 and the plurality of blades 22 are configured to be uncovered. As shown in the enlarged view of area A in FIG. 6, the support frame 30 includes a connecting member 31 connected to the hinge rotation shaft 94. This connecting member 31 includes a notch 31C for preventing contact with the hinge 93 and the support wall 81 during rotation. Further, the hinge 93 is configured such that a hinge rotation axis Axh is arranged so that the hinge rotation axis Axh does not overlap with the support wall 81 as viewed from the width direction Dw perpendicular to the fan rotation axis Axf. Specifically, as shown in the enlarged view of region A in FIG. 6, the hinge rotation axis Axh is located behind the rear end 81 RE of the support wall 81. In the present embodiment, the hinge rotation axis Axh, the fan rotation axis Axf, and the width direction Dw are substantially perpendicular to each other.

As a result, the heat exchanger 7, the support frame 30, and the shroud 10 can be rotated 90 degrees or more around the hinge rotation axis Axh. That is, the orientation of the support frame 30 at the second position P2 is obtained by rotating 90 degrees or more about the hinge rotation axis Axh from the orientation of the support frame 30 at the first position P1. In FIG. 6, the heat exchanger 7, the support frame 30 and the shroud 10 at the first position P1 are shown by a solid line, and the support frame 30 and the shroud 10 at the second position P2 are shown by two-dot chain lines. the support frame 30 at the second position P2 is shown by a one dot chain line. The second position as illustrated indicates a position obtained by rotating 90 degrees from the first position P1. Therefore, the heat exchanger 7, the support frame 30, and the shroud 10 can be further rotated about the hinge rotation axis Axh than the illustrated second position P2.

FIG. 7 is a perspective view as seen from the rear when the heat exchanger 7, the support frame 30, and the shroud 10 are arranged at the second position P2. In FIG. 7, the upper cover 89 is opened forwardly. As shown in FIG. 7, when the support frame 30 is positioned at the second position P2, the fan rotating shaft 21 and the plurality of blades 22 are exposed. Therefore an internal space opposite to the opening 82 with respect to the cooling fan 20 is accessible through a gap between the opening 82 and the plurality of blades 22.

Figure 8:
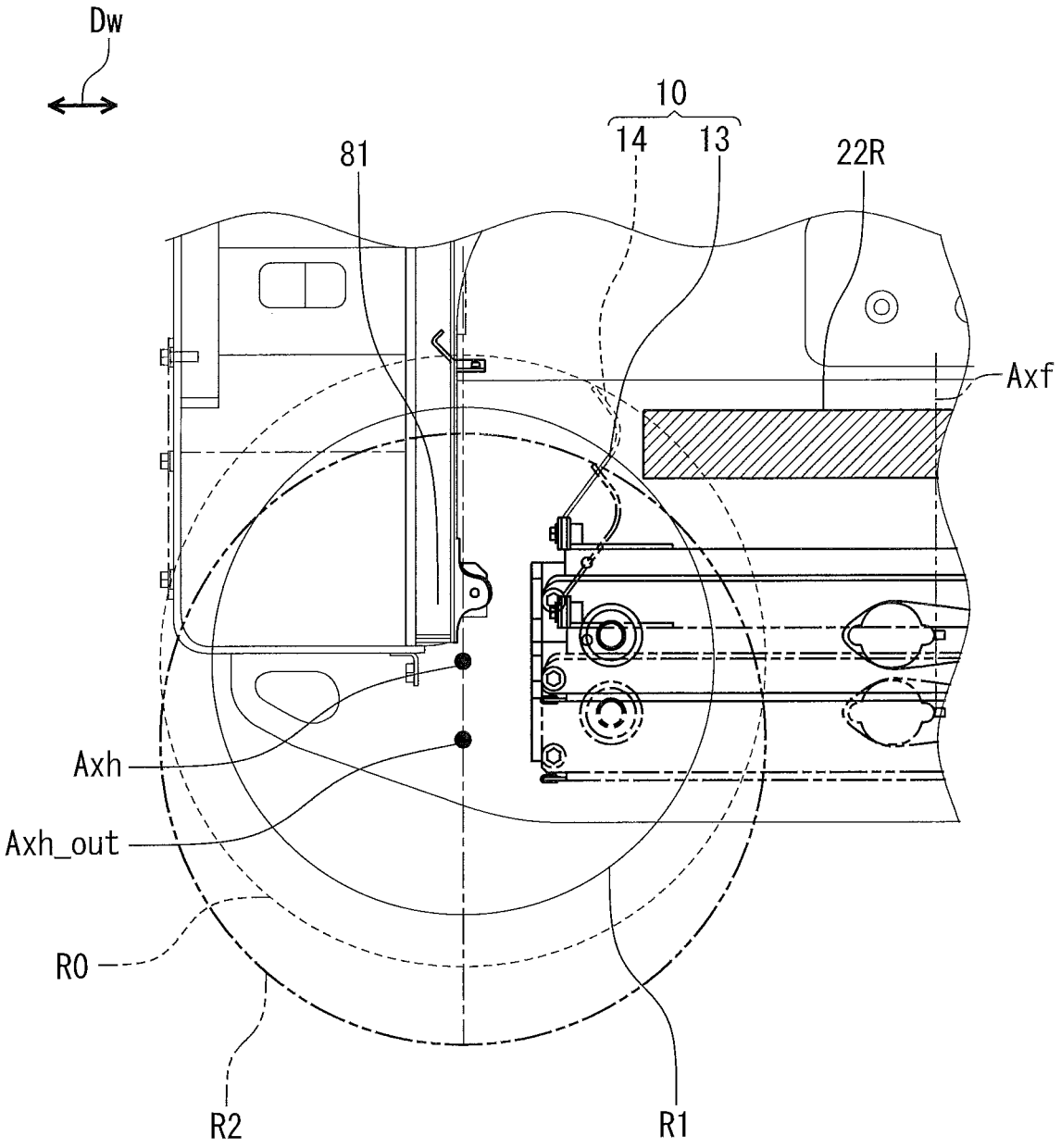
FIG. 8 is a cross-sectional view of the vicinity of the notch by a plane parallel to the width direction and passing through the fan rotation axis.

Referring to FIGS. 6 and 7, a part (proximal end 11) of the shroud 10 (proximal end 11), which is closer to the support wall 81 than the fan rotating shaft 21 in the width direction Dw when the support frame is positioned at the first position P1, has a notch 13 recessed toward the first surface 71. FIG. 8 is a cross-sectional view of the vicinity of the notch 13 by a plane parallel to the width direction Dw and passing through the fan rotation axis Axf. In FIG. 8, a region 22R schematically shows a region through which the plurality of blades 22 pass when they rotate. The shroud 10 includes an extended region 14 located on the opposite side of the notch 13 with respect to the fan rotation axis Axf, and covers the outside in the radial direction with respect to the fan rotation axis Axf of the cooling fan 20. When the shroud 10 includes the extended region 14, the tip of the shroud 10 passes through the path R0 shown in the figure and comes into contact with the plurality of blades 22. In the present embodiment, the shroud 10 is configured to do not contact the plurality of blades 22 by the notch 13 having a configuration in which the extended region 14 is removed, so that the tip of the notch 13 passes through the path R1 when the support frame 30 is rotated.

Figure 9:
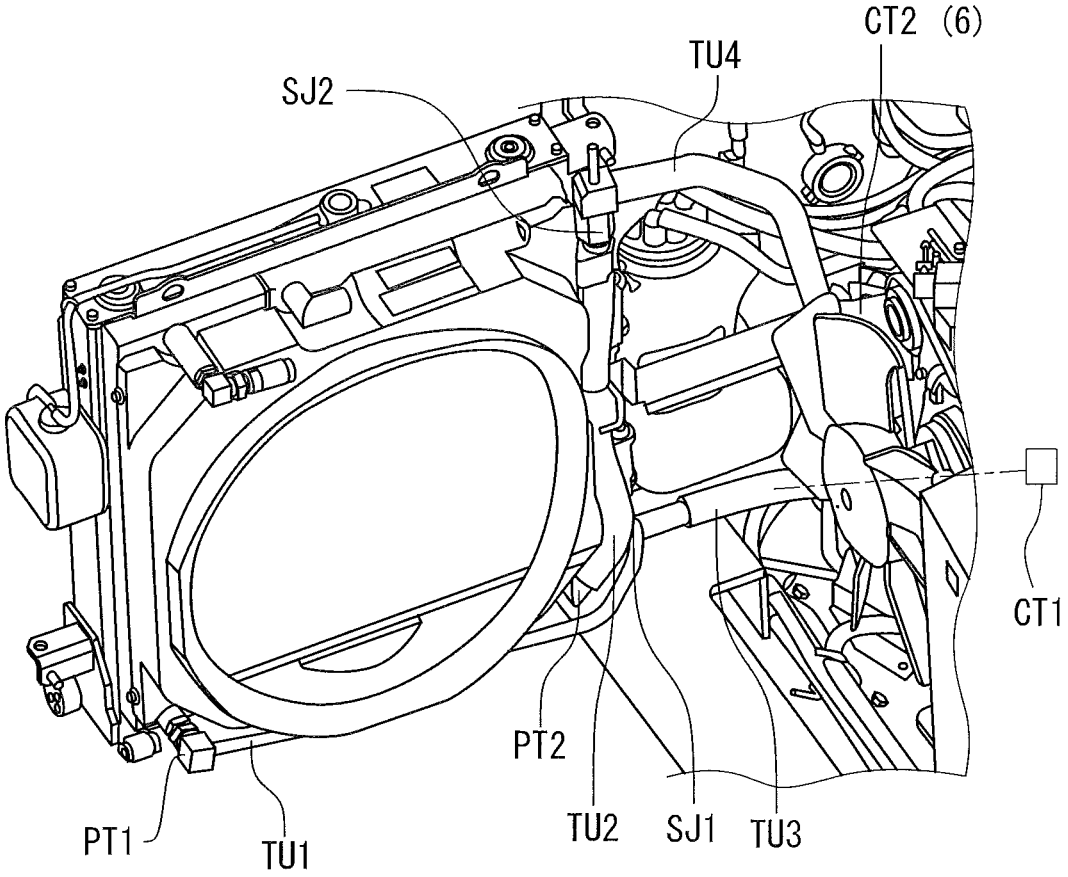
FIG. 9 is an enlarged perspective view of the vicinity of the shroud when the support frame 30 is positioned at the second position.

FIG. 9 is an enlarged perspective view of the vicinity of the shroud 10 when the support frame 30 is located at the second position P2. Referring to FIGS. 5 and 9, the heat exchanger 7 further includes a first connection port PT1 for connecting with a pipe TU1 through which a liquid, which is a refrigerant or a working fluid, flows. The heat exchanger 7 further includes a second connection port PT2 for connecting with a pipe TU2 through which a liquid as a refrigerant or a working oil flows. The heat exchanger 7 includes a first swivel joint SJ1 provided at a position closer to the hinge rotation axis Axh than a first connection port PT1 and a second swivel joint SJ2 provided at a position closer to the hinge rotation axis Axh than a second connection port PT2. A heat exchanger 7 includes a pipe TU1 which connects a first connection port PT1 and a first swivel joint SJ1 and through which the liquid flows, a pipe TU2 which connects a second connection port PT2 and a second swivel joint SJ2 and through which the liquid flows, a pipe TU3 which connects the first swivel joint SJ1 and a third connection port CT1 which is a source or destination of the liquid, and a pipe TU4 which connects the second swivel joint SJ2 and a fourth connection port CT2 which is a source or destination of the liquid. The third connection port CT1 is, for example, a connection port of the hydraulic oil tank. The fourth connection port CT2 is, for example, a connection port to the engine 6 configured to rotate the cooling fan 20. The pipes TU1 and TU2 may be referred to as a first pipe. The pipes TU3 and TU4 may be referred to as second pipe.

FIG. 5 shows a support structure 100 of the heat exchanger 7 when the support frame 30 is located at the first position P1 of the heat exchanger 7. Referring to FIG. 5, the distance DJ1 between the first swivel joint SJ1 and the hinge rotation axis Axh in an additional radial direction Dr with respect to the hinge rotation axis Axh (in FIG. 5, the additional radial direction Dr is the same as the width direction Dw) is shorter than the distance DT1 in the additional radial direction Dr between the first connection port PT1 and the hinge rotation axis Axh. The additional radial direction Dr is perpendicular to the hinge rotation axis Axh. The distance DJ2 in the additional radial direction Dr between the second swivel joint SJ2 and the hinge rotation axis Axh is shorter than the distance DT2 in the additional radial direction Dr between the second connection port PT2 and the hinge rotation axis Axh. When the first connection port PT1 and the third connection port CT1 are connected to each other by one pipe without providing the first swivel joint SJ1, it is necessary to bend the pipe by about 90 degrees so that the pipe does not interfere with the cooling fan 20. When the second connection port PT2 and the fourth connection port CT2 are connected by one pipe without providing the second swivel joint SJ2, it is necessary to bend the pipe by 90 degrees or more so that the pipe does not interfere with the cooling fan 20. By utilizing the first swivel joint SJ1 and the second swivel joint SJ2, it is possible to improve the flexibility of the pipe arrangement. In particular, large bending of the pipe for routing is inhibited.

Effect of First Embodiment

In the support structure 100 of the heat exchanger 7 according to the first embodiment, when the support frame 30 is located at a second position P2 where the heat exchanger 7 exposes the opening 82 to the outside of the vehicle body frame 8, the fan rotating shaft 21 and the plurality of blades 22 are exposed. Therefore, when the member provided with the heat exchanger 7 is opened, access to the engine compartment is facilitated by utilizing the gap between the opening 82 and the plurality of blades 22. In addition, since the notch 13 is configured such that the extended region 14 is removed, the shroud 10 does not come into contact with the plurality of blades 22 when the support frame 30 rotates.

Second Embodiment

Figure 10:
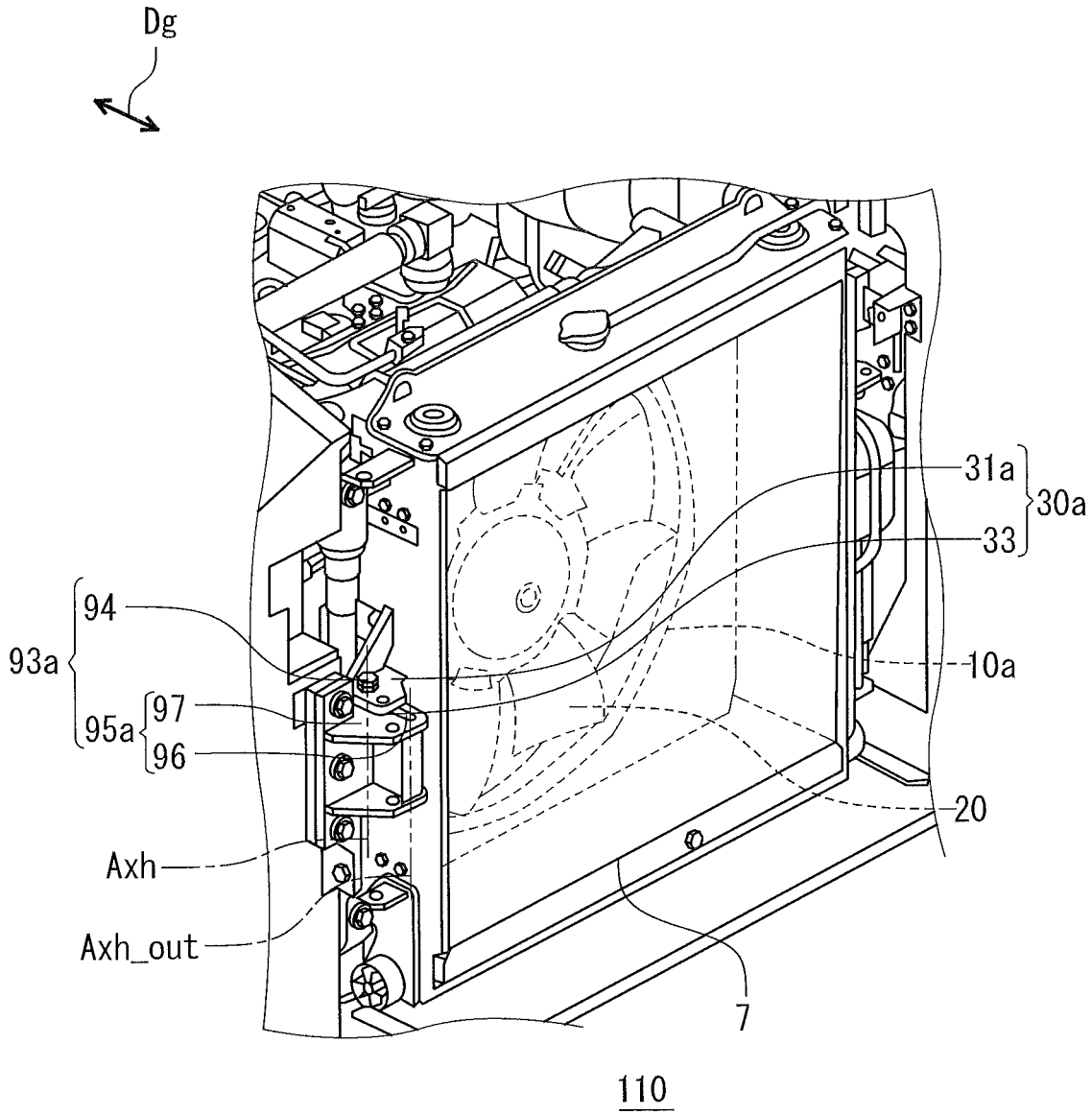
FIG. 10 shows a support structure of a heat exchanger according to a second embodiment.

FIG. 10 shows a support structure 110 of a heat exchanger according to a second embodiment. In FIG. 10, the same components as those of the first embodiment are denoted by the same reference numerals, and detailed description thereof will be omitted. In the support structure 110 of the heat exchanger 7 according to the second embodiment, since the hinge rotation axis Axh defined by the hinge rotation shaft 94 can slide up to Axh_out shown in FIG. 8, the tip of the notch 13 passes through the path R2 when the support frame 30 rotates, even if the shroud 10*a* according to the present embodiment includes the extended region 14 (even if there is no notch 13), so that the shroud 10*a* does not come into contact with the plurality of blades 22.

Thus, in FIG. 10, the support structure 110 includes a hinge 93*a* with a shaft support plate 95*a* having a slot 96 through which the hinge rotation shaft 94 passes. The slot 96 extends in a guide direction Dg intersecting with the hinge rotation axis Axh. More specifically, the guide direction Dg is perpendicular to the hinge rotation axis Axh. The shaft support plate 95*a* has a support surface 97 extending in the guide direction Dg. The support frame 30*a* further includes a connecting member 31*a* connected to the hinge rotation shaft 94. The connecting member 31*a* has a contact surface 33 slidably in contact with the support surface 97.

As shown in FIG. 8, when the hinge rotation shaft 94 is located at one end of the slot 96 (Axh in FIG. 8), the support frame 30*a* is configured to swing around the hinge rotation axis Axh to contact the plurality of blades 22. When hinge rotation shaft 94 is located at the other end (Axh_out in the figure) that is opposite to one end of slot 96, and the support frame 30*a* is configured to swing around the hinge rotation axis Axh (Axh_out in the figure) without contacting the plurality of blades 22. Therefore, when the support frame 30*a* is moved to the second position P2, the hinge rotation axis Axh is located at the position Axh_out in the figure. Therefore, the hinge rotation axis (Axh_out in the figure) is arranged so that when the support frame 30*a* is positioned at the second position P2, the hinge rotation axis (Axh_out in the figure) does not overlap with the support wall 81 as viewed from the width direction Dw. When the support frame 30*a* is positioned at the first position P1, the hinge rotation shaft 94 is positioned such that the hinge rotation axis Axh corresponds to the hinge rotation axis Axh in FIG. 8.

Effect of Second Embodiment

The support structure 110 of the heat exchanger according to the second embodiment has a hinge 93*a* including a shaft support plate 95*a* having a slot 96 through which the hinge rotation shaft 94 passes. The slot 96 extends in a guide direction Dg intersecting with the hinge rotation axis Axh. When the hinge rotation shaft 94 is located at one end (Axh in the figure) of the slot 96, the support frame 30*a* can be brought into contact with the plurality of blades 22 by swinging the support frame 30*a* around the hinge rotation axis Axh. When the hinge rotation shaft 94 is located at the other end (Axh_out in the figure) opposite to the one end of the slot 96 and the support frame 30*a* is swung around the hinge rotation axis (Axh_out in the figure), the support frame 30*a* does not contact with the plurality of blades 22. Therefore, it is not necessary for the shroud 10*a* to provide the notch 13. As a result, when the support frame 30*a* is located at the first position P1, the shroud 10*a* can completely cover the periphery of the plurality of blades 22, so that the cooling efficiency of the heat exchanger 7 can be improved. Further, since the hinge rotation shaft 94 can be slid to the position of Axh_out and the support frame 30*a* can be largely rotated, the engine compartment can be easily accessed through the gap between the opening 82 and the plurality of blades 22.

As used herein, "comprising" and its derivatives are non-limiting terms that describe the presence of a component, and do not exclude the presence of other components not described. This also applies to "having", "including" and their derivatives.

The terms "member," "part," "element," "body," and "structure" may have multiple meanings, such as a single part or multiple parts.

Ordinal numbers such as "first" and "second" are simply terms used to identify configurations and do not have other meanings (e.g., a particular order). For example, the presence of the "first element" does not imply the presence of the "second element", and the presence of the "second element" does not imply the presence of the "first element".

Terms such as "substantially", "about", and "approximately" indicating degrees can mean reasonable deviations such that the final result is not significantly altered, unless otherwise stated in the embodiments. All numerical values described herein may be interpreted to include words such as "substantially," "about," and "approximately."

In the present application, the phrase "at least one of A and B" should be interpreted to include only A, only B, and both A and B.

In view of the above disclosure, it will be apparent that various changes and modifications of the present invention are possible. Therefore, the present invention may be carried out by a method different from the specific disclosure of the present application without departing from the spirit of the present invention.

What is claimed is:

1. A support structure for a work vehicle, comprising:

a heat exchanger having a first surface and a second surface opposite to the first surface in an air-flow direction in which cooling air is configured to pass through the heat exchanger;

a shroud having a tubular shape which has a proximal end and a distal end opposite to the proximal end in the air-flow direction, the proximal end covering an outer periphery of the first surface of the heat exchanger, the distal end having a substantially circular shape as viewed in the air-flow direction;

a support frame configured to support the heat exchanger and the shroud to expose the distal end of the shroud and the second surface of the heat exchanger;

a vehicle body frame comprising a support wall and having an opening, a part of an outer periphery of the opening being defined by the support wall;

a hinge connecting the support wall and the support frame and having a hinge rotation axis substantially parallel to a wall surface of the support wall to swing the support frame around the hinge rotation axis;

a cooling fan comprising:

a fan rotating shaft having a fan rotation axis around which the fan rotating shaft is configured to rotate, the fan rotating shaft being provided such that the fan rotating shaft passes through the opening; and blades provided around the fan rotating shaft in the radial direction with respect to the fan rotation axis and configured to rotate around the fan rotation axis to generate the cooling air;

the distal end of the shroud being configured to cover a circumference of the cooling fan in the radial direction so that the cooling air passes through the first surface and the second surface of the heat exchanger when the support frame is positioned at a first position where the heat exchanger faces the cooling fan;

the fan rotating shaft and the blades being configured to be uncovered when the support frame is positioned at a second position where the heat exchanger exposes the opening to an outside of the vehicle body frame;

the hinge rotation axis and the fan rotation axis being skew lines; and the hinge being configured such that, when the support frame is positioned at the second position, the hinge rotation axis is arranged so that the hinge rotation axis does not overlap with the support wall as viewed from a width direction perpendicular to the hinge rotation axis and the fan rotation axis.

2. The support structure according to claim 1, wherein the heat exchanger further includes a connection port to which a pipe is connected, a liquid being configured to flow through the pipe, the support structure further comprising:

a swivel joint provided at a position closer to the hinge rotation axis than the connection port;

a first pipe which connects the connection port with the swivel joint and thorough which the liquid flows; and a second pipe connecting the swivel joint and a connection destination which the liquid flows from or into.

3. The support structure according to claim 2, wherein a distance between the swivel joint and the hinge rotation axis in an additional radial direction with respect to the hinge rotation axis is shorter than a distance between the connection port and the hinge rotation axis in the additional radial direction.

4. The support structure according to claim 1, further comprising:

a cover swingable around a cover rotation axis to cover the second surface of the heat exchanger.

5. The support structure according to claim 4, wherein the cover rotation axis is provided opposite to the hinge rotation axis with respect to the opening.

6. The support structure according to claim 4, wherein the cover has air holes in a portion that faces the second surface when the cover is rotated to a position at which the cover covers the second surface.

7. The support structure according to claim 4, wherein the cover is a bonnet cover.

8. The support structure according to claim 1, wherein the shroud has a notch which is recessed toward the first surface and which is closer to the support wall than the fan rotating shaft in the width direction when the support frame is located at the first position.

9. The support structure according to claim 1, wherein the hinge comprises a hinge rotation shaft having the hinge rotation axis and extending along the hinge rotation axis, the hinge rotation shaft being swingable together with the support frame, and a support plate attached to the support wall and having a slot through which the hinge rotation shaft passes, and wherein the slot extends in a guide direction intersecting with the hinge rotation axis.

10. The support structure according to claim 9, wherein the guide direction is perpendicular to the hinge rotation axis.

11. The support structure according to claim 9, wherein the shaft support plate has a support surface extending in the guide direction, wherein the support frame further includes a connecting member connected to the hinge rotation shaft, and wherein the connecting member has a contact surface slidably in contact with the support surface.

12. The support structure according to claim 9, wherein, when the hinge rotation shaft is positioned at one end of the slot, the support frame is configured to rotate around the hinge rotation axis to contact the blades, and wherein, when the hinge rotation shaft is positioned at the other end of the slot opposite to the one end, the support frame is configured to rotate around the hinge rotation axis without contacting the blades.

13. The support structure according to claim 1, wherein, when the support frame is located at the second position, an internal space opposite to the opening with respect to the cooling fan is accessible through a gap between two adjacent blades among the blades.

14. The support structure according to claim 1, wherein an orientation of the support frame at the second position is obtained by rotating at least 90 degrees around the hinge rotation axis from the orientation of the support frame at the first position.

15. A work vehicle comprising:

the support structure according to claim 1.

16. The support structure according to claim 2, wherein the liquid includes at least one of a refrigerant or a hydraulic fluid.

* * * * *